US005174561A

United States Patent [19]

Lebeau

[11] Patent Number: 5,174,561

[45] Date of Patent: Dec. 29, 1992

[54] APPARATUS FOR TREATING SECURITIES SUCH AS BILLS, WITH IDLE ROLLERS

[75] Inventor: Christophe Lebeau, Le Chesnay, France

[73] Assignee: Dassault Electronique, Saint-Cloud, France

[21] Appl. No.: 732,597

[22] Filed: Jul. 19, 1991

[51] Int. Cl.[5] ..... B65H 29/00

[52] U.S. Cl. ..... 271/186; 271/314; 271/82; 271/207

[58] Field of Search ..... 271/185, 186, 187, 314, 271/315, 81, 82, 83, 207, 277, 982

[56] References Cited

U.S. PATENT DOCUMENTS

| | | | |
|---|---|---|---|
| 3,046,009 | 7/1962 | Hartel | 271/186 |
| 5,031,893 | 7/1991 | Yoneda et al. | 271/186 |
| 5,065,997 | 11/1991 | Butts et al. | 271/187 |

FOREIGN PATENT DOCUMENTS

| | | |
|---|---|---|
| 59-69341 (A) | 4/1984 | Japan . |
| 61-150959 | 7/1986 | Japan . |
| 62-79156 (A) | 4/1987 | Japan . |
| 2168687 | 6/1986 | United Kingdom . |

*Primary Examiner*—H. Grant Skaggs
*Attorney, Agent, or Firm*—Christie, Parker and Hale

[57] ABSTRACT

A central roller (70) is driven into constant motion by a toothed belt (85) and by drive rollers (88, 89.) A moving element comprising a bracket (92) bearing an idle roller (90) that is elastically biased toward the central roller is mounted on the shaft (7) of the central roller, and this assembly is separately driven by the rollers (78, 79), by a toothed belt (75) and a drive system (MC, 77). An entering bill is inserted between the rollers (70) and (90). The shaft of the roller (90) remains stationary until the bill has moved passed it in a predetermined manner. Thereafter, the moving element (92) driven into rotation at a controlled angular speed exceeding that of the roller(70), whereby the bill shall be constantly held between the central roller (70) and the idle roller (90) while this same idle roller (90) however moves toward the end of the bill until releasing it into a bin.

10 Claims, 4 Drawing Sheets

Figure 1:
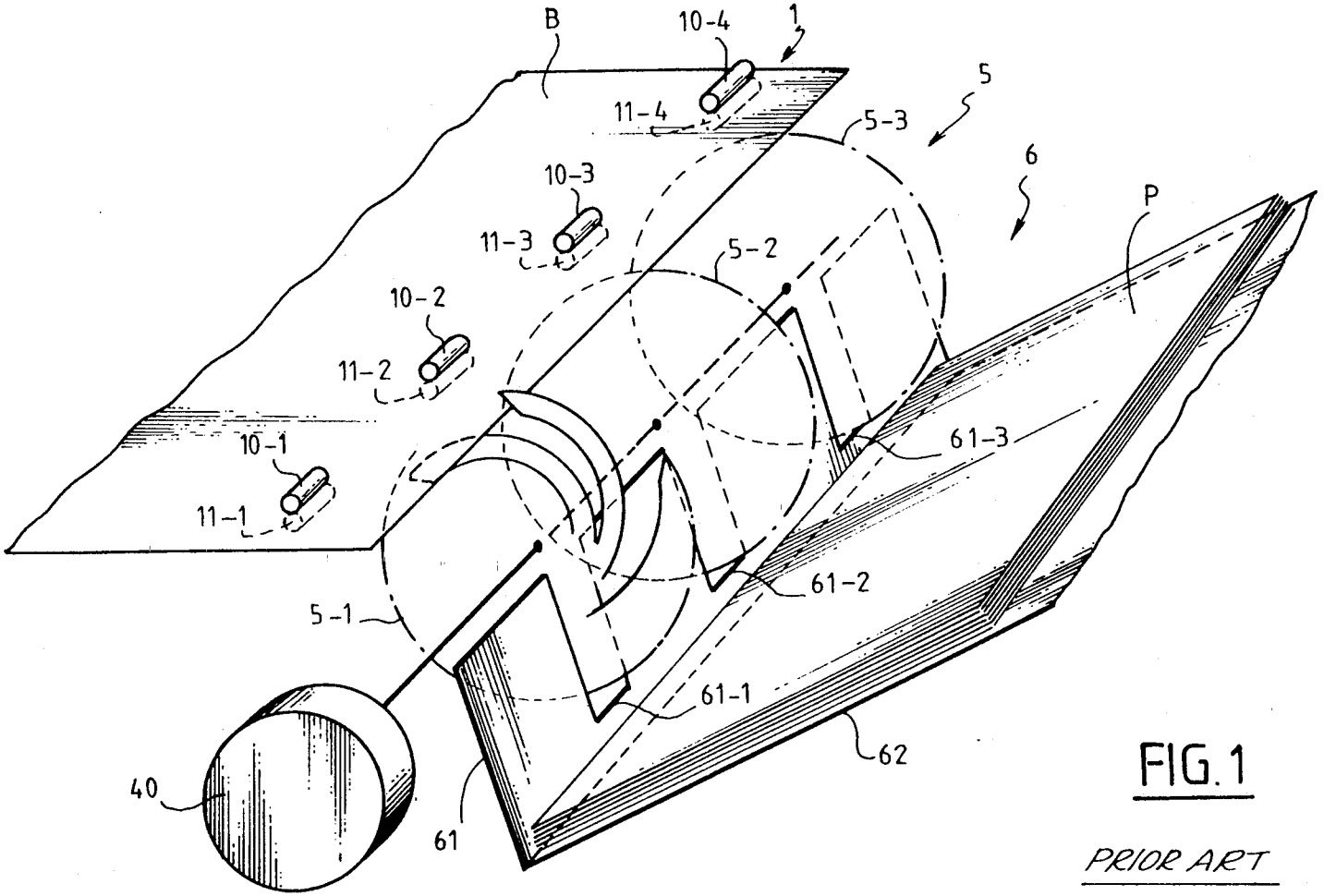
FIG. 1 PRIOR ART

FIG.4
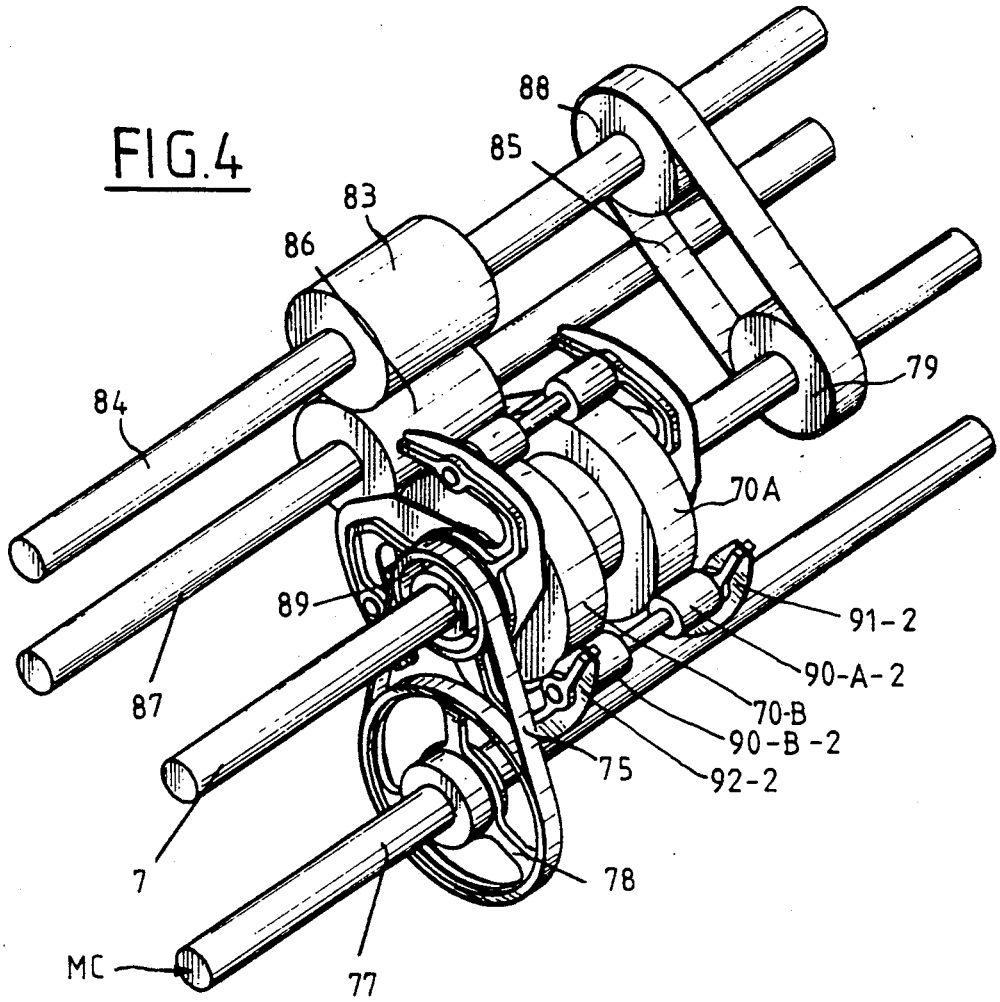
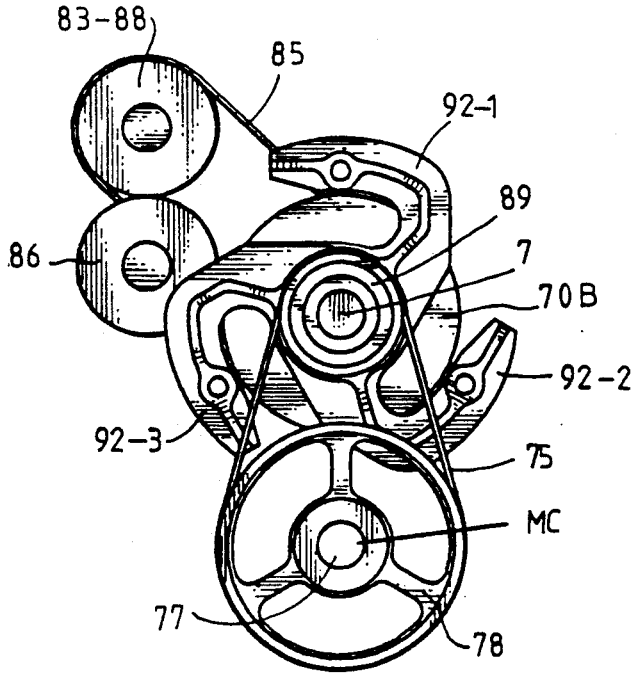
FIG. 3

APPARATUS FOR TREATING SECURITIES SUCH AS BILLS, WITH IDLE ROLLERS

The invention concerns the treatment of securities, in particular currency bills.

As regards a known automatic teller, the bills are removed from a cassette and then translated by a roller conveyor. Thereupon they arrive on a set of one or several wheels with blades. Each bill enters an inter-blade space. The wheel motion moves this bill to a container where it is stopped, almost in a flat position, in order to be stacked with other bills. The pile so made lastly is delivered to the user.

An automatic teller must be fast and evince maximum reliability of operation both as regards the banker and the customer.

The blade-wheels incur inherent technical limitations and fail to be fully satisfactory.

The present invention offers apparatus of another species.

This apparatus comprises:

an intake conveyor suitable to assure the translation of one security at a time, a bin with a first blank acting as a stop to hold a bill and allowing its stacking on a second blank, and means for transferring securities one at a time between the exit of the intake conveyor and this bin.

In the invention, instead of the blade wheels, these transfer means comprise:

a central roller rotating at a controlled speed, in particular at constant speed, a moving element rotating coaxially with the central roller and bearing at least one idle or satellite peripheral roller which is elastically biased toward the central roller, the tangent point of the central roller with the idle roller being essentially in the axis of the intake conveyor when the said moving element is in a position which is its waiting position, and control means reacting upon a predetermined advance of a security between the central roller and the peripheral roller in that they temporarily drive in controlled manner said moving element at an angular speed exceeding that of the central roller, whereby the idle roller projects beyond the end of the security before this security meets the first blank of the container.

In practice the central roller periphery and part of the moving element, together with the idle roller, cross the first blank through a clearance in it. Obviously several assemblies of central and idle rollers can be provided if called for by the width(s) of the security or securities.

In particular, the moving element includes, as regards each idle roller, a support of generally prone U shape with one end rotating independently and coaxially with the central roller whereas the other end lets the idle roller rotate, the U aperture facing the conveyor when in said waiting position.

In a particular embodiment, the central roller and the moving element are belt-driven, preferably by a toothed belt, both in the continuous and in the temporarily actuated modes.

The moving element may comprise two diametrically opposite idle rollers or three idle rollers equidistant by 120°.

Obviously, in the case of several moving elements, they bear the same number of idle rollers.

Advantageously the control means consist of at least one stepping motor to precisely control the angular displacement of the moving element.

It comprises a securities detector downstream of the waiting position of the idle roller and in a predetermined position.

In a particular significant feature of the invention, the elastic bias of the idle roller toward the central roller is adjusted in relation to the thickness and stiffness of the securities.

Other features and advantages of the invention are elucidated in the following description and in relation to the attached drawings.

Figure 2:
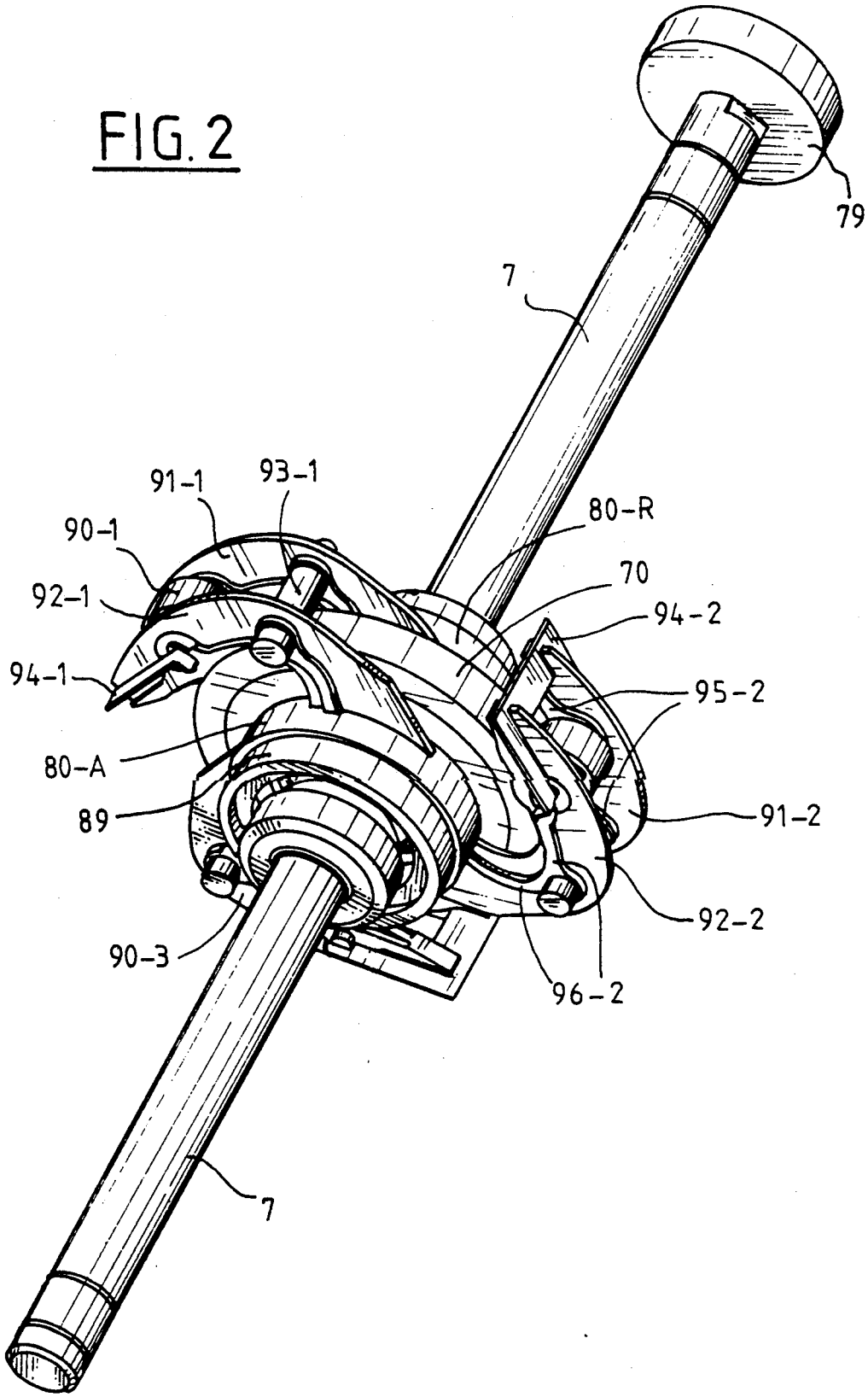

FIG. 1 schematically illustrates a blade-wheel apparatus of the prior art,

FIG. 2 is a perspective of the detailed structure of a transfer means of the present invention, FIG. 3 schematically illustrates in more detail an embodiment of the drive of the apparatus of the invention, FIG. 4 is a perspective illustrating the apparatus of FIG. 3, and FIGS. 5*a*–5*f* are much simplified schematics elucidating the operation of the drive means of the invention.

Essentially the attached drawings comprise definite components. Accordingly they are an integral part of the description. In this respect, as called for, they not only elucidate this description, but also may contribute to define the invention.

FIG. 1 shows the exit 1 of a roller conveyor moving a bill B. The last set of rollers is shown, which consists of four pairs of rollers each with an upper and a lower roller 10 and 10, each identified by a suffix specific to each pair. Such a dispenser or automatic teller serves to process several types of bills. It is designed for the bills of the largest dimensions.

One or several blade wheels are mounted on the shaft of a motor 40, which may be stepping motor, in the prior art. Here three blade wheels 5-1 through 5-3 are shown, with only the blades of the wheel 5-1 being schematically entered on the drawing for the sake of clarity.

The bill stacking-and-bundling bin consists mostly of two blanks 61 and 62. Between them they subtend an angle nearly 90°. The vertical blank 61 is notched at 61-1, 61-2 and 61-3 to provide clearances for the three blade wheels 5-1 through 5-3.

The pile of bills assembled at the end is shown by P in the bin.

FIG. 2 shows in more detailed form one of the bill transfer-members that may replace the blade wheels, on its shaft 7.

This shaft 7 bears a toothed-belt roller 79 and a so-called central roller 70.

Driven by the roller 79, this assembly therefore can rotate freely. The assembly is driven at constant speed by a stepping motor or by a regulated DC motor or by being directly linked to the upstream bill conveyance means.

The moving element is mounted by ball bearings on this assembly and comprises a front ring 80-A which is rigidly affixed to a roller 89 which can be driven by the toothed belt, and a rear ring 80-R. These rings comprise three brackets denoted by the subscripts 1, 2 and 3. Only one of these will be described.

These brackets consist of lateral cheeks 91-1 and 92-1 which are joined by a spacer 93-1.

The geometry of the rings 80-A and 80-R causes these brackets 91-1 and 92-1 to define a prone U shape, herein open leftward.

The brackets 91-1 and 92-1 define the upper part of the U. Near their free end, they support a peripheral roller 90-1. The shaft of this roller is biased toward the central roller 70 by elastic strips such as 94-1 and by its rear corresponding part which is shown more clearly at 94-2 on the moving element with the suffix 2.

The drawing also shows supports denoted by 95-2 and 96-2 for shafts mounted in the brackets 91-2 and 92-2 resp.

Accordingly this moving element is composed of three idle rollers mounted on their respective brackets and elastically biased in controlled manner by the springs 94 toward the central roller 70.

Obviously several moving elements of this type can be mounted on the shaft 7 as the width of the securities or bills requires.

It is apparent at once that the radial bulk of such apparatus is less than for conventional blade wheels.

Part of the apparatus passes through the clearances such as 61-1 through 61-3 in the vertical blank of the encased bin as shown in FIG. 1 for the prior art.

As noted above, the central roller can be driven by a stepping motor or by a DC motor or directly from the upstream conveyor means. It need not be driven synchronously with the peripheral roller once the speed has been suitably stabilized.

As shown by FIGS. 3 and 4, the central roller 70 is split into 70A and 70B and is driven by means of the pulley 79 and the rollers 83 and 86 of the intake conveyor. The moving element consists of the brackets 91, 92 and of the also split idle rollers 90A and 90B.

A roller 89 formed on the bracket 92 is driven from a drive sprocket wheel 78 mounted on a shaft 77 by means of a toothed belt 75. Drive controls MC act on the shaft 77 to drive brackets such as 92 and consequently rollers such as 90A and 90B. Illustratively such drive means are a stepping motor with an open-loop drive control.

FIGS. 5*a* through 5*f* shall presently be discussed.

Figure 5A:
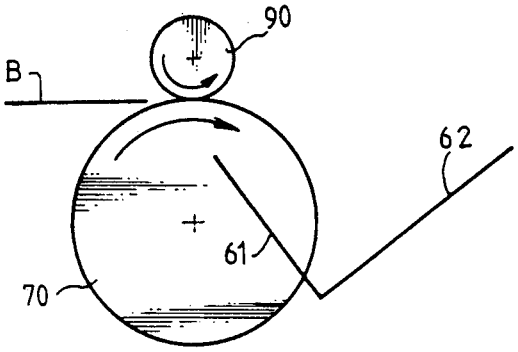

FIG. 5*a* shows the shaft of the idle roller 90 being substantially vertically aligned with the shaft of the central roller 70, whereby the tangent point of the two rollers substantially is located in the output shaft of the bills intake conveyor 1 (FIG. 1). The central roller 70 rotates at constant speed and thereby forces the idle roller 90 to rotate at the same linear speed while its shaft however remains stationary.

A bill B arrives at the same linear speed and enters between the two rollers 90 and 70. Be it borne in mind that the pressure from the roller 90 against the roller 70 is adjusted by springs 94 in relation to the thickness and stiffness of the bills.

Figure 5B:
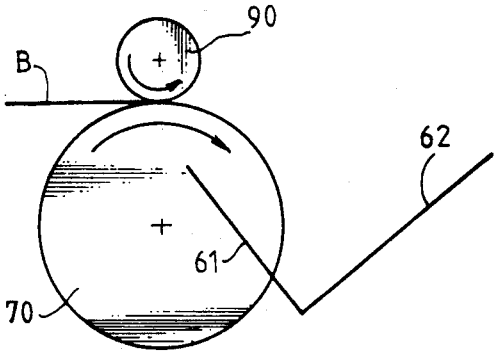

In FIG. 5*b*, the bill B has begun its entry between the two rollers 90 and 70.

Figure 5C:
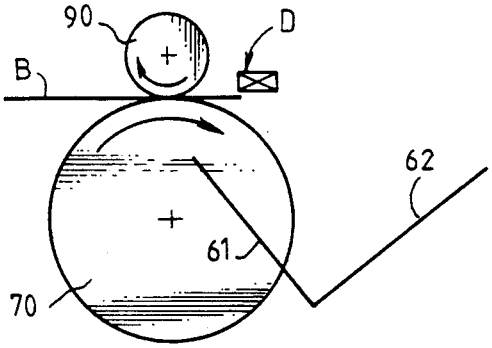
Figure 5D:
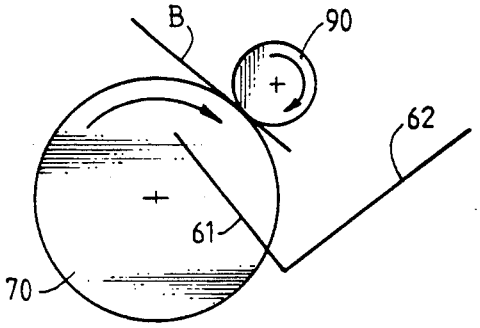

In FIG. 5*c*, there has been advance of the bill B and its straight end has arrived at the point where a detector D is operative.

This detector is mounted in a predetermined manner relative to the waiting position of the roller 90. Preferably it shall be mounted outside the zone within which the brackets 91 and 92 are operative. Illustratively this may be a bill detector such as a photo-electric barrier, or better yet, a bill detector operating on the reflection of an optical signal.

The moment the detector senses arrival of the bill, the roller 90 will be driven by its moving element at an angular speed exceeding that of the central roller 70. Accordingly the means described in relation to FIGS. 3 and 4 become operative.

Thereupon the shaft of the roller 90 moves toward the right end of the bill B while the roller 90 still continues rolling on the central roller 70 and hence, in cooperation with it, keeps holding the bill.

Figure 5E:
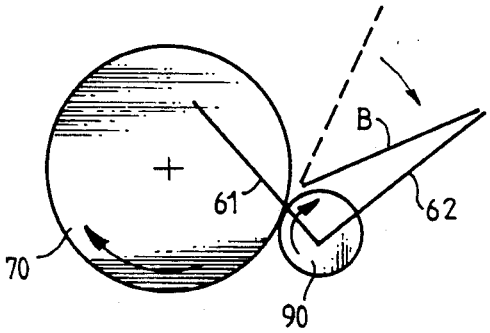

The angular speed imparted to the moving element 90 is adjusted so that with respect to the position shown in FIG. 5*e*, the roller 90 has moved beyond the right end of the bill which then is released but in a position of tipping-over to drop the bottom of the bin 62.

Figure 5F:
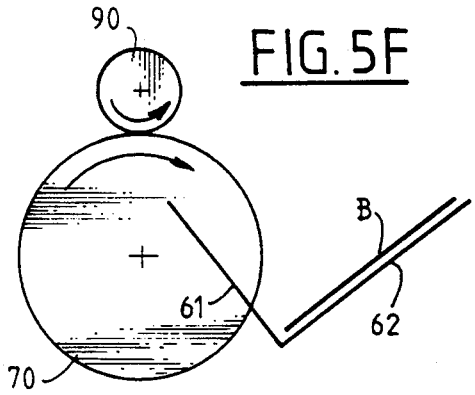

Thereafter, the roller 90 together with part of the moving element and the central roller 70 shall have crossed a clearance in the blank 61 and shall speedily return to the waiting position illustrated in FIG. 5*f*.

This description presupposes there is only one idle roller. If there are several, obviously it will not be the same roller, but the next one clockwise that shall assume the waiting position.

If there are two rollers 180° apart, the moment that the roller which just ceased operating has released the bill into the bin constituted by the blanks 61 and 62, there shall be one roller in the waiting position.

The apparatus of the invention is especially significant because allowing processing numerous types of securities by means of a simple, compact system practically requiring only one detector and most of all keeping a permanent hold on the bill until it is deposited into the bin 6.

Obviously the bill is not restricted to the above described embodiment modes, but it covers all variations of the spirit of the invention. For instance certain drive systems for the moving element(s) were described above. Obviously the expert may introduce many variations. Similarly, even though in fact two or three sets of rollers 90 are preferred, a larger number is conceivable.

I claim:

1. Apparatus for processing securities, in particular, currency bills, comprising:

an intake conveyor (1) assuring the translation of one security at a time;

a bin (6) with a first blank (61) acting as a stop for a bill and allowing to stack it on a second blank (62); and at least one means (5) for transferring securities one at a time between the exit of the intake conveyor and this bin, characterized in that these transfer means comprises:

a central roller (70) rotating at controlled speed, wherein the controlled speed is constant;

a moving element (92) rotating coaxially with the central roller and bearing at least one idle peripheral roller (90) elastically biased (94) toward the central roller and evincing a waiting position wherein the tangent point between the central roller and the idle roller is substantially in line with an outlet of the intake conveyor; and control means (MC) reacting to a predetermined advance of a security or currency bill between the central and the peripheral rollers by temporarily driving said moving element in controlled manner at a speed exceeding that of the central roller, whereby the idle roller projects beyond the front end of the security before this security hits the first bin blank.

2. Apparatus defined in claim 1, characterized in that the periphery of the central roller (70) and part of the moving element (92) together with the idle roller (90) cross the first blank through a clearance (61-1 through 61-3).

3. Apparatus defined in claim 1, characterized in that the moving element includes, with respect to each idle roller (90), a support (92) in the overall shape of a prone U of which one end is mounted coaxially with the central roller and rotates independently of the central roller, and wherein the other end supports the idle roller and the U opening faces the conveyor in the waiting position.

4. Apparatus defined in claim 3, characterized in that the central roller and the moving element are each driven by a belt (85, 75).

5. Apparatus defined in claim 1, characterized in that the moving element bears at least two idle rollers (90).

6. Apparatus defined in claim 1, characterized in that the moving element bears three idle rollers (90) equidistant by 120°.

7. Apparatus defined in claim 1, characterized in that the control means (MC) include at least one stepping motor.

8. Apparatus defined in claim 1, characterized in that the control means include a securities detector (D) downstream of the idle-roller waiting position and in a predetermined position.

9. Apparatus defined in claim 1, characterized in that the elastic bias (95) of the idle roller toward the central roller is adjusted in relation to the thickness and stiffness of the securities.

10. Apparatus for processing securities, in particular, currency bills, comprising:

an intake conveyor (1) assuring the translation of one security at a time;

a bin (6) with a first blank (61) acting as a stop for a bill and allowing to stack it on a second blank (62); and at least one means (5) for transferring securities one at a time between the exit of the intake conveyor and this bin, characterized in that these transfer means comprises:

a central roller (70) rotating at controlled speed;

a moving element (92) rotating coaxially with the central roller and bearing at least one idle peripheral roller (90) elastically biased (94) toward the central roller and evincing a waiting position wherein the tangent point between the central roller and the idle roller is substantially in line with an outlet of the intake conveyor; and control means (MC) reacting to a predetermined advance of a security or currency bill between the central and the peripheral rollers by temporarily driving said moving element in controlled manner at a speed exceeding that of the central roller, whereby the idle roller projects beyond the front end of the security before this security hits the first bin blank, wherein the moving element includes, with respect to each idle roller, a support in the overall shape of a prone U of which one end is mounted coaxially with the central roller and rotates independently of the central roller, and wherein the other end supports the idle roller and the U opening faces the conveyor in the waiting position.

* * * * *

UNITED STATES PATENT AND TRADEMARK OFFICE

CERTIFICATE OF CORRECTION

PATENT NO. : 5,174,561

DATED : December 29, 1992

INVENTOR(S) : Christophe Lebeau

It is certified that error appears in the above-identified patent and that said Letters Patent is hereby corrected as shown below:

On the title page:

Abstract, line 10, change "passed" to -- past --.
Abstract, line 11, before "driven" insert -- is --.

Column 1, line 6, after "particular" insert a comma.
Column 1, line 13, change "The pile so made lastly" to -- The last pile so made --.

Column 2, line 39, before "stepping" insert -- a --.

Column 3, line 12, change "resp" to -- respectively --.

Signed and Sealed this

First Day of February, 1994

Bruce Lehman

*Attest:*

BRUCE LEHMAN

*Attesting Officer*

*Commissioner of Patents and Trademarks*